US008112825B2

(12) United States Patent
Li et al.

(10) Patent No.: US 8,112,825 B2
(45) Date of Patent: Feb. 14, 2012

(54) SEAT WITH MASSAGE FUNCTION

(75) Inventors: Yue Li, Hong Kong (CN); Jicheng Pan, Shenzhen (CN); Fei Li, Shenzhen (CN); Yongqiang Song, Shenzhen (CN); Gang Peng, Shenzhen (CN); Guanlei Jiang, Shenzhen (CN); Zongwang Lv, Shenzhen (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 441 days.

(21) Appl. No.: 12/419,383

(22) Filed: Apr. 7, 2009

(65) Prior Publication Data

US 2009/0249534 A1 Oct. 8, 2009

(30) Foreign Application Priority Data

Apr. 7, 2008 (CN) ..... 2008 1 0066459

(51) Int. Cl.
*A47K 13/00* (2006.01)

(52) U.S. Cl. ..... 4/237; 601/49; 601/67; 601/70

(58) Field of Classification Search ..... 4/237; 601/46, 601/49, 56–60, 65–67, 69–70
See application file for complete search history.

(56) References Cited

U.S. PATENT DOCUMENTS

| | | | | |
|---|---|---|---|---|
| 3,244,168 | A | 4/1966 | Bayard | |
| 4,920,583 | A | 5/1990 | Hough et al. | |
| 5,713,832 | A * | 2/1998 | Jain | 601/49 |
| 5,898,957 | A * | 5/1999 | Hansen et al. | 4/541.1 |
| 2004/0176711 | A1 | 9/2004 | Yang | |
| 2005/0070826 | A1 * | 3/2005 | Hsiao | 601/57 |
| 2005/0215926 | A1 * | 9/2005 | Thrasher | 601/70 |
| 2007/0032752 | A1 * | 2/2007 | Wu | 601/57 |

FOREIGN PATENT DOCUMENTS

JP 7303582 11/1995

* cited by examiner

*Primary Examiner* — Charles Phillips
(74) *Attorney, Agent, or Firm* — Muncy, Geissler, Olds & Lowe, PLLC

(57) ABSTRACT

A toilet seat includes a body with a plurality of massage mechanisms installed in the body, and means for sealing the massage mechanisms. The massage mechanism includes a housing which comprises an upper part and a lower cover part, a motor held between the upper part and the lower cover part, an eccentric weight fixed to the output shaft of the motor, and a resilient suspension device for suspending the assembly of the motor, the eccentric weight and the housing inside the body. The suspension device includes a housing fixing end fixed to the housing, a body fixing end fixed to the body, and a connecting part connected between the two fixing ends. In use, the motor rotates the eccentric weight to thereby produce vibrations which are transmitted to a user sitting on the seat.

10 Claims, 3 Drawing Sheets

SEAT WITH MASSAGE FUNCTION

CROSS REFERENCE TO RELATED APPLICATIONS

This non-provisional patent application claims priority under 35 U.S.C. §119(a) from Patent Application No. 200810066459.6 filed in The People's Republic of China on Apr. 7, 2008.

FIELD OF THE INVENTION

The present invention relates to massage seats, and in particular to toilet seats with a massage function.

BACKGROUND OF THE INVENTION

Massaging toilet seats have been known for many years. This idea has been to help the user to relax when sitting on the toilet seat by having a device which causes the entire seat to vibrate or move rapidly from side to side. While this has been found to be relaxing for some users, the massage mechanism requires a large vibrator to move the entire seat. Also, it has been found that smaller, direct vibrations can have a more beneficial massage or stimulating effect, especially when the vibrations are applied in certain discrete locations such as acupuncture or acupressure locations. To be able to combine this discrete stimulation in a toilet seat gives added advantages. In the modern society trend of pursuing efficiency, people are very busy and do not have enough spare time to use single function massage devices merely for pleasure.

As such, it is desirable to provide novelty daily necessities, such as a toilet seat, with a massage function which allow people to be massaged when using these necessaries, or which at least provide the general public with a useful choice.

SUMMARY OF THE INVENTION

Accordingly, the present invention provides a toilet seat, comprising a body adapted to support users thereon, a plurality of massage mechanisms installed in the body, and means for sealing the massage mechanisms, wherein the massage mechanism comprises a housing, a motor held in the housing, an eccentric weight fixed to the output shaft of the motor, and a suspension device configured to suspend the combined motor, eccentric weight and housing inside the body and to resiliently urge the housing into contact with the sealing means, the suspension device comprising a housing fixing end fixed to the housing, a body fixing end fixed to the body, and a connecting part connected between the fixing ends, whereby when the motor is turned on, the motor rotates the eccentric weight thereby producing vibrations which are transmitted to the user sitting on the seat via the housing and sealing means.

Preferably, the housing comprises an upper part and a lower part, and the motor is sandwiched between the upper part and the lower part.

Preferably, the housing fixing end of the suspension device is provided with through holes, one of the upper part and the lower part is provided with through holes, and the other of the upper part and the lower part is provided with screw holes, screws pass though the respective through holes and engage the screw holes, so as to fix the housing fixing end of the suspension device between the upper part and the lower part.

Preferably, the body has a through hole corresponding to each massage mechanism, and the sealing means comprises a plurality of waterproof covers fixed to the through holes of the body for sealing the through holes, the waterproof covers contacting with the housings of the massage mechanisms for transmitting vibrations from the housings to the user.

Preferably, the body has an annular groove round each through hole, the waterproof covers are made of an elastomeric material, the periphery of each waterproof cover forms a flange and the flanges are sealingly engaged in the corresponding annular grooves of the body.

Preferably, the waterproof cover has a plurality of hooks adjacent to the flange, arranged to catch the periphery of the corresponding through hole of the body, so as to prevent the flange of the waterproof cover from escaping from the annular groove of the body.

Alternatively, the body has a part with a reduced thickness corresponding to each massage mechanism, and the parts acting as the sealing means and contact with the housings of the massage mechanisms for transmitting vibrations from the housings to the user.

Alternatively, the body corresponding to each massage mechanism is provided with a through hole, and a thin waterproof layer is secured to the outer surface of the body to seal the through hole, the waterproof thin layer acting as the sealing means and contacts with the housings of the massage mechanisms for transmitting vibrations from the housings to the user.

Preferably, the suspension device is an elastic strip, and the connecting part of the elastic strip comprises a plurality of bending structures.

Preferably, the inner surface of the body is provided with a plurality of fixing parts, each of the fixing parts having a screw hole, the body fixing end of each elastic strip has at least one through hole, and screws pass through the respective through holes of the elastic strips to be locked in the screw holes of the body, thereby fixing the housing to the body.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DESCRIPTION OF THE PREFERRED EMBODIMENT

Figure 1A:
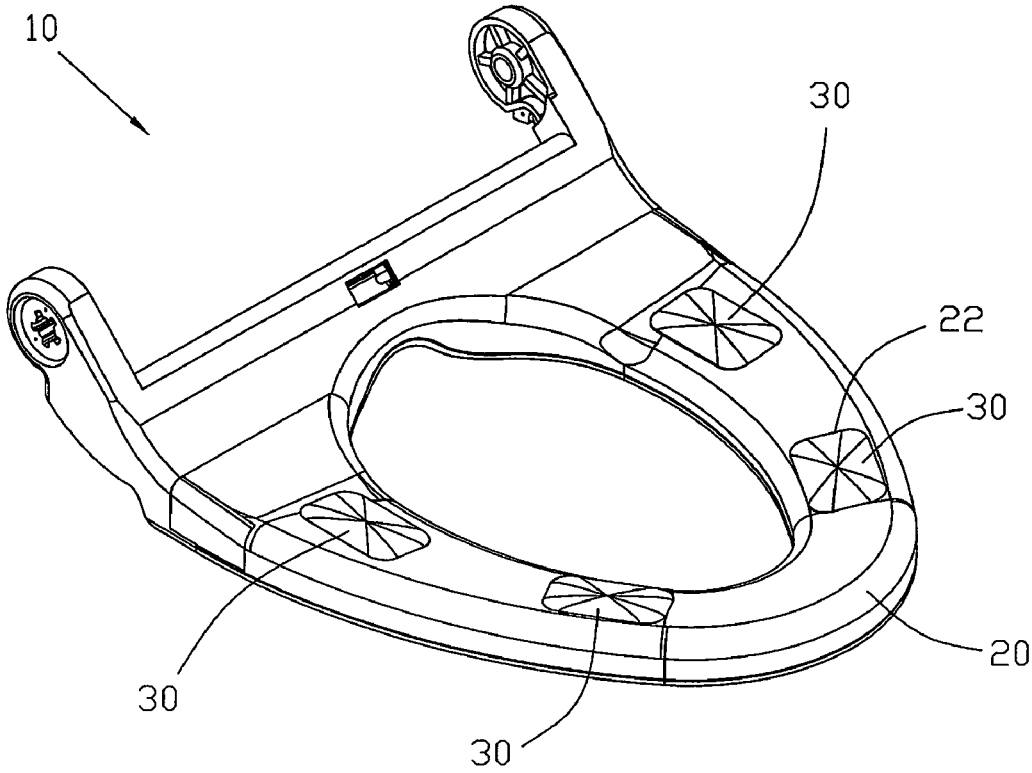
FIG. 1A is an isometric view of a toilet seat in accordance with a first embodiment of the present invention.

The technical problem to be solved, the technical solution and the beneficial effects of the present invention are best understood from the following detailed description of a preferred embodiment, with reference to the accompanying figures. It is to be understood that the specific embodiments described here are merely examples to explain the invention and are not intended to limit the present invention.

FIGS. 1A to 1D show a toilet seat 10 in accordance with a preferred first embodiment of the present invention. The seat 10 comprises a body 20 which is provided with a plurality of through holes 22. A massage mechanism 30 is fixed in each of the through holes 22.

The massage mechanism 30 comprises: a housing which has an upper part 32*a* and a lower part 32*b*, a motor 34 sandwiched between the upper part 32*a* and the lower part 32*b*, an eccentric weight 36 fixed to the output shaft of the motor 34, a resilient suspension device 38, and a cover 40, preferably waterproof, fixed to the periphery of the corresponding through hole 22 to seal the through hole 22. The cover 40 is supported by or otherwise in contact with the upper part 32*a* of the housing.

Figure 1B:
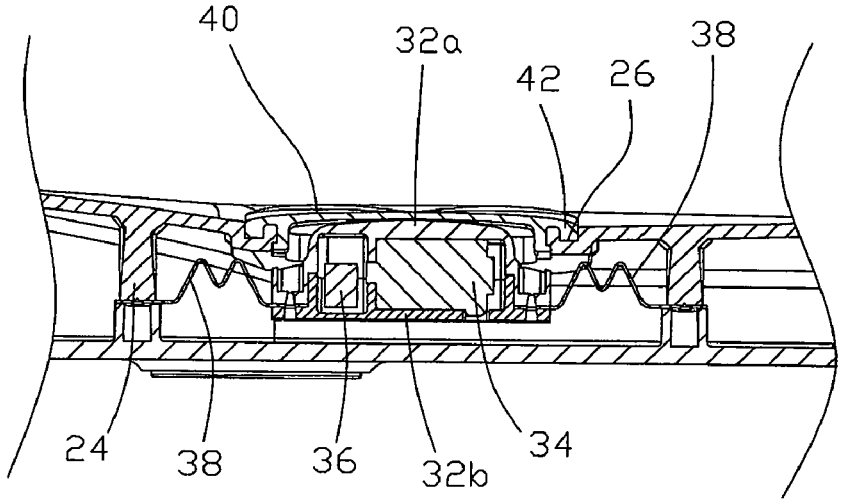
FIG. 1B is a cross sectional view of a part of the seat of FIG. 1A, showing a massage mechanism installed in a body of the seat.
Figure 1C:
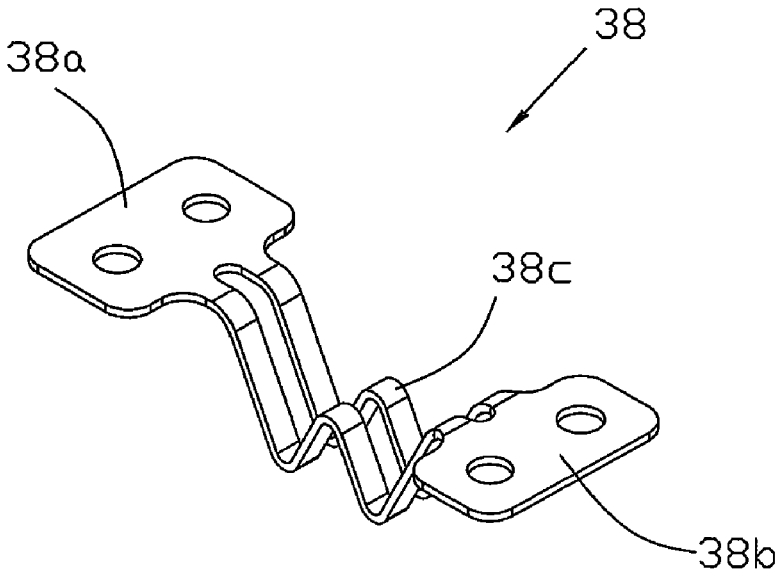
FIG. 1C is an isometric view of a suspension device for the massage mechanism of FIG. 1B.

Referring to FIGS. 1B and 1C, the suspension device 38 has a housing fixing end 38*a* attached to the housing, a body fixing end 38*b* attached to the body 20, a connecting part 38*c* connecting together the two fixing ends 38*a*, 38*b*. The housing fixing end 38*a* has several through holes; one of the upper part 32*a* and the lower part 38*b* is also provided with through holes, and the other is provided with screw holes. Screws (not shown) pass though the respective through holes to be screwed into the screw holes, so as to fix the housing fixing end 38*a* of the suspension device 38 between the upper part 32*a* and lower part 32*b* of the housing. The bottom surface of the body 20 is provided with several fixing parts 24 and each fixing part 24 has a screw hole. The body fixing end 38*b* of the suspension device 38 is provided with through holes, and screws (not shown) pass through the respective through holes of the body fixing end 38*b* to be fastened into the screw holes of fixing parts 24 of the body 20. Thus, the combined motor 34, eccentric weight 36 and housing are suspended inside the body 20 via the suspension device 38. In the embodiment of the present embodiment, the suspension device 38 comprises two elastic strips, and the connecting part 38*c* of each elastic strips is provided with a plurality of bending structures. Alternatively, the suspension device 38 may be in other forms, such as leaf springs.

Figure 1D:
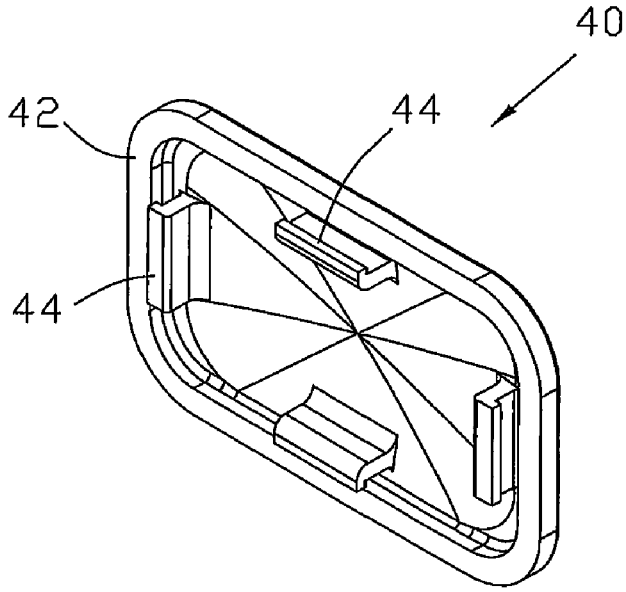
FIG. 1D is an isometric view of a waterproof cover, being a part of the seat of FIG. 1A.

Referring to FIG. 1B and FIG. 1D, an annular groove 26 is formed in the upper surface of the body 20 adjacent to the periphery of the through hole 22. The periphery of the cover 40 is provided with a flange 42. The flange 42 is sealingly engaged in the groove 26 of the body 20. A plurality of hooks 44 are formed on the cover 40 adjacent to the flange 42. The hooks 42 are configured to catch the periphery of the through holes 22 of the body 20, so as to prevent the flange 42 escaping from the groove 26 of the body 20. In the embodiment of the present invention, the cover 40 is made of elastomeric material such as rubber, and the flange 42 is sealingly contained in the groove 26 of the body 20, so as to prevent liquids such as water from entering inside of the body 20.

In use, when the motor 34 is turned on, the motor 34 rotates the eccentric weight 36 thereby causing the housing to vibrate. Since the upper part 32*a* of the housing is held in contact with the cover 40, the vibrations are transmitted to the cover 40 which in turn will stimulate a user sitting on the seat 10 in contact with the cover 40. The locations of the massage mechanisms can be chosen to correspond to specific locations of a typical user, such as acupressure points, to provide direct stimulation to these areas.

Figure 2:
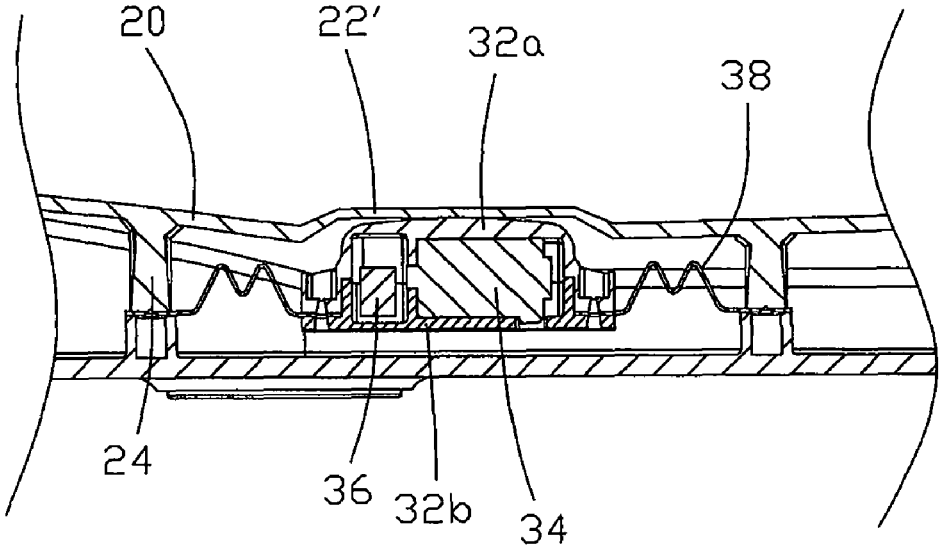
FIG. 2 is a cross sectional view of a massage mechanism installed in the body of the seat in accordance with a second embodiment of the present invention.

FIG. 2 illustrates a seat according to a second embodiment of the present invention, which is similar to the seat of the first embodiment. The difference is that the body 20 integrally forms a part 22' having a reduced thickness corresponding to each massage mechanism 30. Part 22' abuts against the upper part 32*a* of the massage mechanism 30 such that part 22' is capable of transmitting vibrations generated by the motor 34 and the eccentric weight 36 of the massage mechanism 30 to a user sitting on the seat 10.

Figure 3:
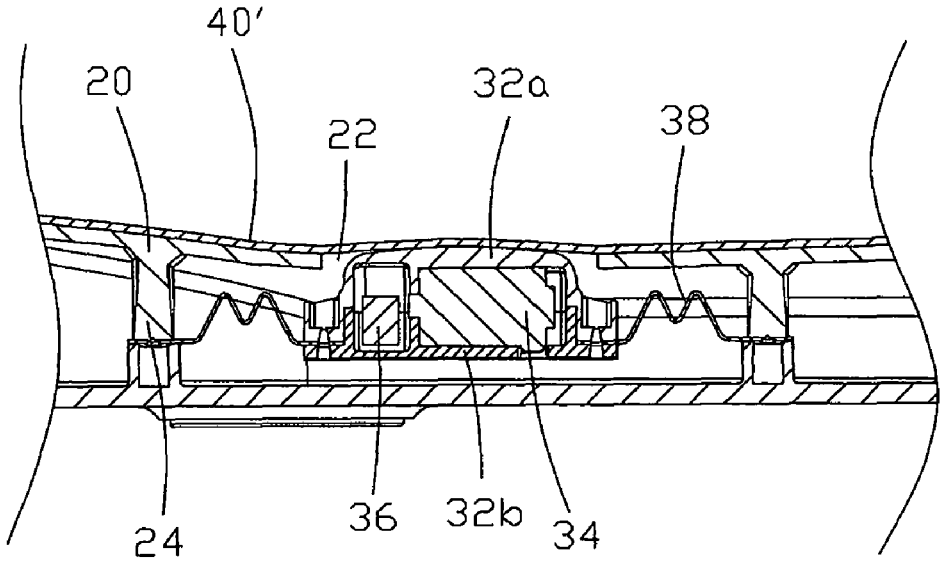
FIG. 3 is a cross sectional view of a massage mechanism installed in the body of the seat in accordance with a further embodiment of the present invention.

FIG. 3 illustrates a seat according to another alternative embodiment of the present invention, which is similar to the seat of the first embodiment. The difference is that a thin waterproof layer 40' is provided on the outer surface of the body 20 to seal the through holes 22 of the body 20. The thin waterproof layer contacts with the upper part 32*a* of the massage mechanism 30 for transmitting vibrations from motor 34 to a user sitting on the seat 10. The thin waterproof layer may be a thin plastic or rubber layer.

In the above mentioned embodiments of the present invention, when the users are using the seat, the massage mechanisms of the seat can massage at particular sites or specific acupuncture points of a user's body. Thus, the users can have a massage when using necessaries of life.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A toilet seat, comprising a body adapted to support users of a toilet bowl thereon, at least one massage mechanism installed in an opening of said body, and means for sealing said opening, wherein said at least one massage mechanism comprises a housing, a motor held in said housing, an eccentric weight fixed to an output shaft of said motor, and at least two suspension devices configured to suspend the combined motor, eccentric weight and housing inside said opening of said body and to resiliently urge said housing into contact with said means for sealing, each suspension device comprising a housing fixing end fixed to said housing, a body fixing end fixed to said body, and a resilient connecting part connected between the fixing ends, whereby when said motor is turned on, said motor rotates said eccentric weight thereby producing vibrations which are transmitted to the user sitting on the seat via resilient urging of said housing into contact with said sealing means.

2. The seat of claim 1, wherein the housing comprises an upper part and a lower part, and the motor is sandwiched between the upper part and the lower part.

3. The seat of claim 2, wherein the housing fixing end of the suspension device is provided with through holes, one of the upper part and the lower part is provided with through holes, and the other of the upper part and the lower part is provided with screw holes, screws pass though the respective through holes and engage the screw holes, so as to fix the housing fixing end of the suspension device between the upper part and the lower part.

4. The seat of claim 1, wherein the body has a through hole corresponding to each massage mechanism, and the sealing means comprises a plurality of waterproof covers fixed to the through holes of the body for sealing the through holes, the waterproof covers contacting with the housings of the massage mechanisms for transmitting vibrations from the housings to the user.

5. The seat of claim 4, wherein the body has an annular groove round each through hole, the waterproof covers are made of an elastomeric material, the periphery of each waterproof cover forms a flange and the flanges are sealingly engaged in the corresponding annular groove of the body.

6. The seat of claim 5, wherein the waterproof cover has a plurality of hooks adjacent to the flange, arranged to catch the periphery of the corresponding through hole of the body, so as to prevent the flange of the waterproof cover from escaping from the annular groove of the body.

7. The seat of claim 1, wherein the body has a part with a reduced thickness corresponding to each massage mechanism, and the parts acting as the sealing means and contact with the housings of the massage mechanisms for transmitting vibrations from the housings to the user.

8. The seat of claim 1, wherein the body corresponding to each massage mechanism is provided with a through hole, and a thin waterproof layer is secured to the outer surface of the body to seal the through hole, the waterproof thin layer acting as the sealing means and contacts with the housings of the massage mechanisms for transmitting vibrations from the housings to the user.

9. The seat of claim 1, wherein the suspension device is an elastic strip, and the connecting part of the elastic strip comprises a plurality of bending structures.

10. The seat of claim 9, wherein the inner surface of the body is provided with a plurality of fixing parts, each of the fixing parts having a screw hole, the body fixing end of each elastic strip has at least one through hole, and screws pass through the respective through holes of the elastic strips to be locked in the screw holes of the body, thereby fixing the housing to the body.

* * * * *